US005445542A

United States Patent [19]

Serizay

[11] Patent Number: 5,445,542

[45] Date of Patent: Aug. 29, 1995

[54] SHIELDING BAND FOR ELECTRICAL CONNECTORS AND CONNECTOR FITTED WITH SAME

[75] Inventor: Dominique Serizay, Saulx sur Huysnes, France

[73] Assignee: Framatome Connectors France, Versailles, France

[21] Appl. No.: 245,825

[22] Filed: May 19, 1994

Related U.S. Application Data

[63] Continuation of Ser. No. 983,016, Nov. 30, 1992, abandoned.

[30] Foreign Application Priority Data

Nov. 29, 1991 [FR] France ..... 91 14796

[51] Int. Cl.[6] ..... H01R 13/648

[52] U.S. Cl. ..... 439/609; 439/827

[58] Field of Search ..... 439/92, 93, 94, 96, 439/108, 497, 607, 608, 609, 610, 827, 924

[56] References Cited

U.S. PATENT DOCUMENTS

| | | | |
|---|---|---|---|
| 3,597,724 | 8/1971 | Phillips | 439/609 X |
| 3,609,632 | 9/1971 | Vetter | 439/609 X |
| 3,678,445 | 7/1972 | Brancaleone | 439/609 |
| 4,106,839 | 8/1978 | Cooper | 439/609 |
| 4,432,919 | 1/1984 | Hillis . | |
| 4,655,532 | 4/1987 | Hillis et al. . | |
| 4,874,337 | 10/1989 | Paukovits, Jr. et al. . | |
| 4,975,085 | 12/1990 | Cartesse et al. | 439/609 |

FOREIGN PATENT DOCUMENTS

| | | |
|---|---|---|
| 0310945 | 4/1989 | European Pat. Off. . |
| 0358562 | 3/1990 | European Pat. Off. . |
| 2360191 | 2/1978 | France . |
| 2135533 | 2/1984 | United Kingdom . |

OTHER PUBLICATIONS

Instrument Specialties Co., Inc. Brochure, vol. 2/393, Gold Book 75/76.

*Primary Examiner*—Khiem Nguyen

*Attorney, Agent, or Firm*—Andrus, Sceales, Starke & Sawall

[57] ABSTRACT

Shielding band for electrical connectors of the type comprising discrete spring metal contact blades located and fixed in an annular seat formed on at least one of the two connector housings by an elastic fixing arrangement. The contact blades are elastically deformable open loops at least one end of which is able to move freely relative to the other end. The contact blades fixing arrangement comprises at least one flexible tie in the form of a ring accommodated inside the loops.

18 Claims, 6 Drawing Sheets

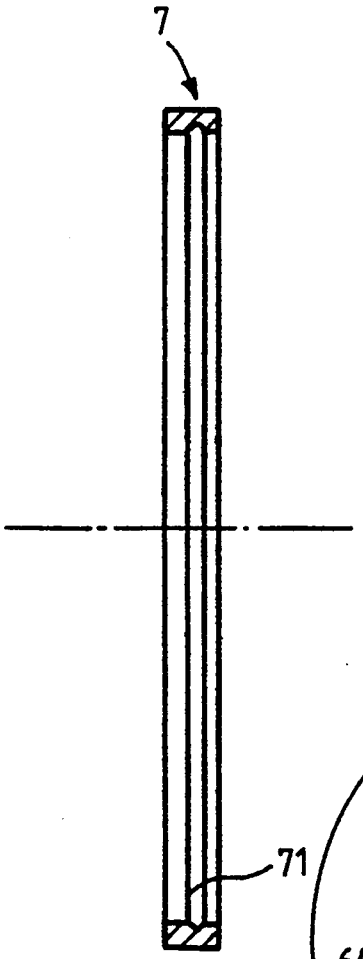
FIG_7
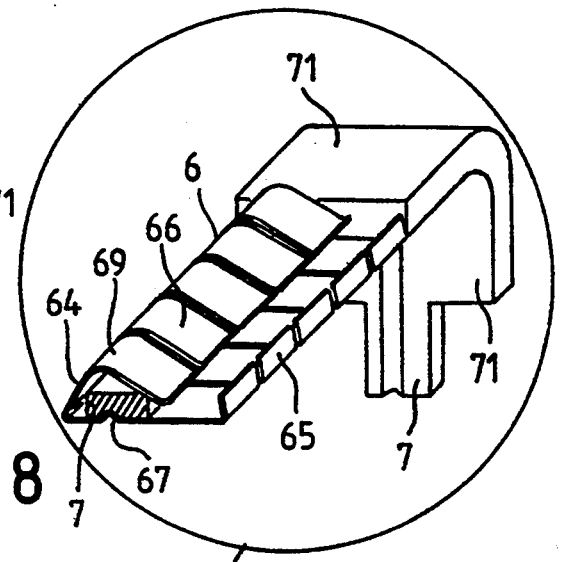
FIG_8
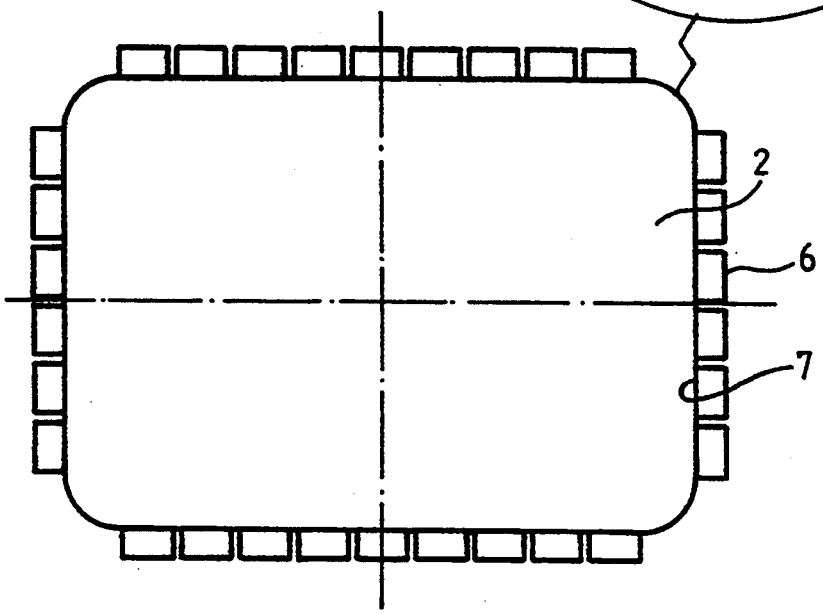

SHIELDING BAND FOR ELECTRICAL CONNECTORS AND CONNECTOR FITTED WITH SAME

This application is a continuation application Ser. No. 07/983,016 filed Nov. 30, 1992, now abandoned.

BACKGROUND OF THE INVENTION

1. Field of the Invention

The invention concerns shielding bands designed to be fitted to connector housings to provide electrical continuity between the male and female members in order to protect the electrical terminals and the signals that they convey from external electromagnetic interference.

2. Description of the Prior Art

The male and female housings of electrical connectors are coupled according to the male member/female member principle. They are manufactured in metal or an electrically conductive composite material and surround the insulative members carrying the electrical terminals and which are set back from the housing interface so that the latter are coupled and located automatically before the terminals are connected.

The shielding band may be implemented in various designs but usually comprises a succession of elastically deformable contact blades positioned in an annular groove formed on the outside surface of the projecting body of the male member, said blades being fixed into this groove by flexible or rigid coupling means.

In the disclosure of the patent U.S. Pat. No. 4,874,337, the contact blades are spring metal parts which are of flattened V-shape with the open side facing towards the female member. They are retained in the groove on the male member by one or more elastic bands pressing the base of the V into the groove whilst leaving its branches free. The ends of the branches are curved outwardly and before the male member is connected to the female member they project from the periphery of the projecting body of the male member. When the male and female housings are coupled (which is facilitated by annular bevels formed at the respective entry of each of the two members) the curved parts of the elastic wings of the spring blades enter in positive contact with the inside wall of the female member which causes them to retract partially towards the back of the groove in which the contact blades are located. The branches of the blades are therefore elastically stressed at all times the two housings are coupled together and the shielding electrical contact is made before the terminals are connected in order to protect them from any electromagnetic interference.

In the disclosure of the patent U.S. Pat. No. 4,975,085 the contact blades comprise a strip of spring metal slightly curved at the center to form a flared cup the two branches of which are bent through 180° hairpin-fashion to define two contact wings projecting from the periphery of the projecting body of the male member. These elastic blades are linked together by an uncut portion of the initial metal strip and are fixed into the back of the groove by a plate resting on a shoulder formed at the entry of said groove and fixed to the strip supporting the contact blades by crimping, clipping, brazing or adhesive bonding.

The major drawback of the prior art shielding bands lies essentially in the difficulty of fitting them to the respective housing body. The connector housings, as used in aeronautical applications, among others, are usually relatively inaccessible and it is periodically necessary to change the shielding bands. It is therefore extremely desirable for the mounting and demounting of such bands to be as easy as possible so that the operator is not required to demount the connector completely. Prior art shielding bands and in particular those described hereinabove use a multitude of separate and independent parts (contact blades, flexible connecting members, crimped or clipped plate, etc) and fitting them to the connector housing body is particularly laborious especially when it is necessary to fit connecting members to independent contact blades that are difficult to position individually on their respective seats or when it is necessary to crimp, clip or glue the fixing means in a difficultly accessible place.

SUMMARY OF THE INVENTION

An object of the invention is to remedy these drawbacks and to this end the invention comprises a shielding band for electrical connectors of the type comprising discrete spring metal contact blades located and fixed in an annular seat formed on at least one of the two connector housings by elastic fixing means, in which band said contact blades are elastically deformable open loops at least one end of which is able to move freely relative to the other end, said contact blade fixing means comprising at least one flexible tie in the form of a ring accommodated inside the loops.

In one embodiment of the invention said contact blades are hairpin shaped and their ends are freely movable relative to each other.

According to one feature of the invention said contact blades comprise a rectilinear core incorporating a locating bend whose apex faces away from the back of the groove constituting the contact blade seat.

According to another feature of the invention said rectilinear core is extended at one end by a curved main branch the convex side of which faces the same way as the locating bend and at the other end by the shorter branch bent at substantially 90°, the ends of the two branches being spaced from each other.

Other features and advantages will emerge from the following description and the appended drawings.

BRIEF DESCRIPTION OF THE DRAWINGS

FIG. 7 is a view in cross-section of the fixing tie.

FIG. 8 is a diagrammatic view of the shielding band.

DETAILED DESCRIPTION OF THE INVENTION

The main object of the invention resides in the novel design of a shielding band forming a unitary assembly and adapted to be easily fitted to or removed from a connector housing without it being necessary to demount said housing. To make the description clearer, the male and female connector housings will be respectively referred to as the "male member" and the "female member" although in actual fact the male member may enclose contact sockets and the female member may comprise pins adapted to be inserted into these sockets.

Figure 1:
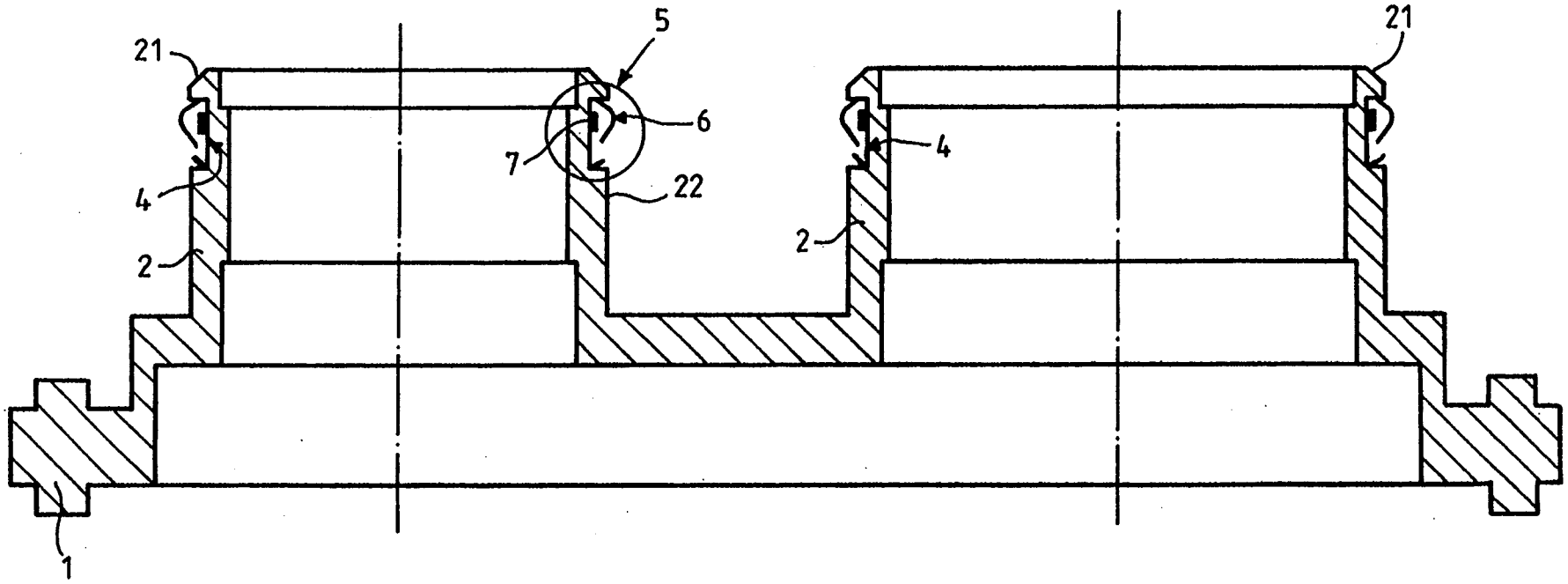
FIG. 1 is an enlarged view of the connector housing from FIG. 2 in cross-section on the line A—A.

As shown in FIG. 1, the male member comprises a flange 1 from one side of which projects at least one projecting body 2 adapted to slide into the socket that the female member 3 (FIG. 5) constitutes. In this example the male member comprises two projecting bodies each of which is provided with an annular groove 4 adapted to receive a shielding band 5. Each projecting body 2 incorporates an annular bevel 21 to facilitate its insertion into the female member 3 which likewise comprises an entry ramp 31 guiding the male and female members to facilitate their coupling.

The object of the shielding band 5 is to establish electrical continuity between the male and female members in order to intercept external electromagnetic interference. The male and female members are obviously manufactured in an electrically conductive material, for example a metal or a charged synthetic material, and are usually grounded.

Figure 3:
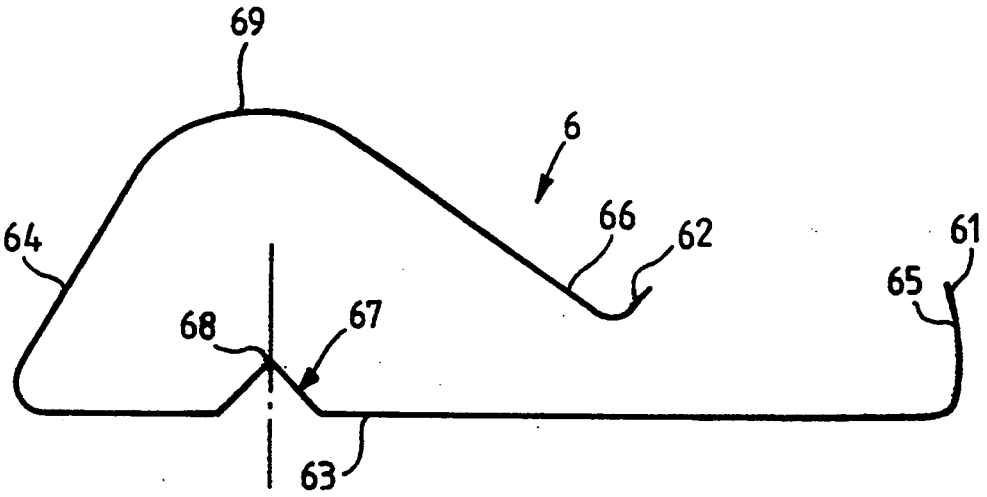
FIG. 3 is a plan view of a contact blade before it is deformed.
Figure 4:
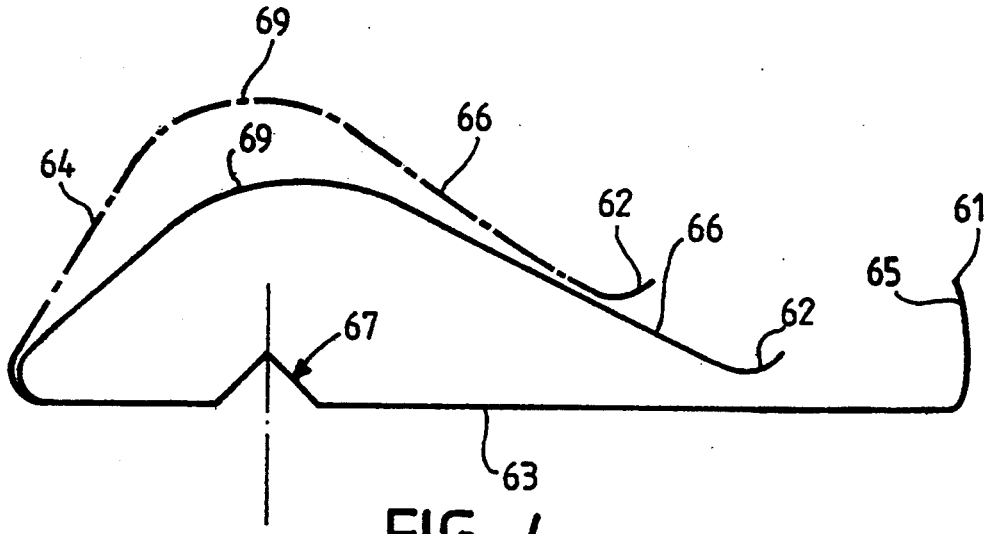
FIG. 4 is a plan view of the contact blade partially retracted.
Figure 5:
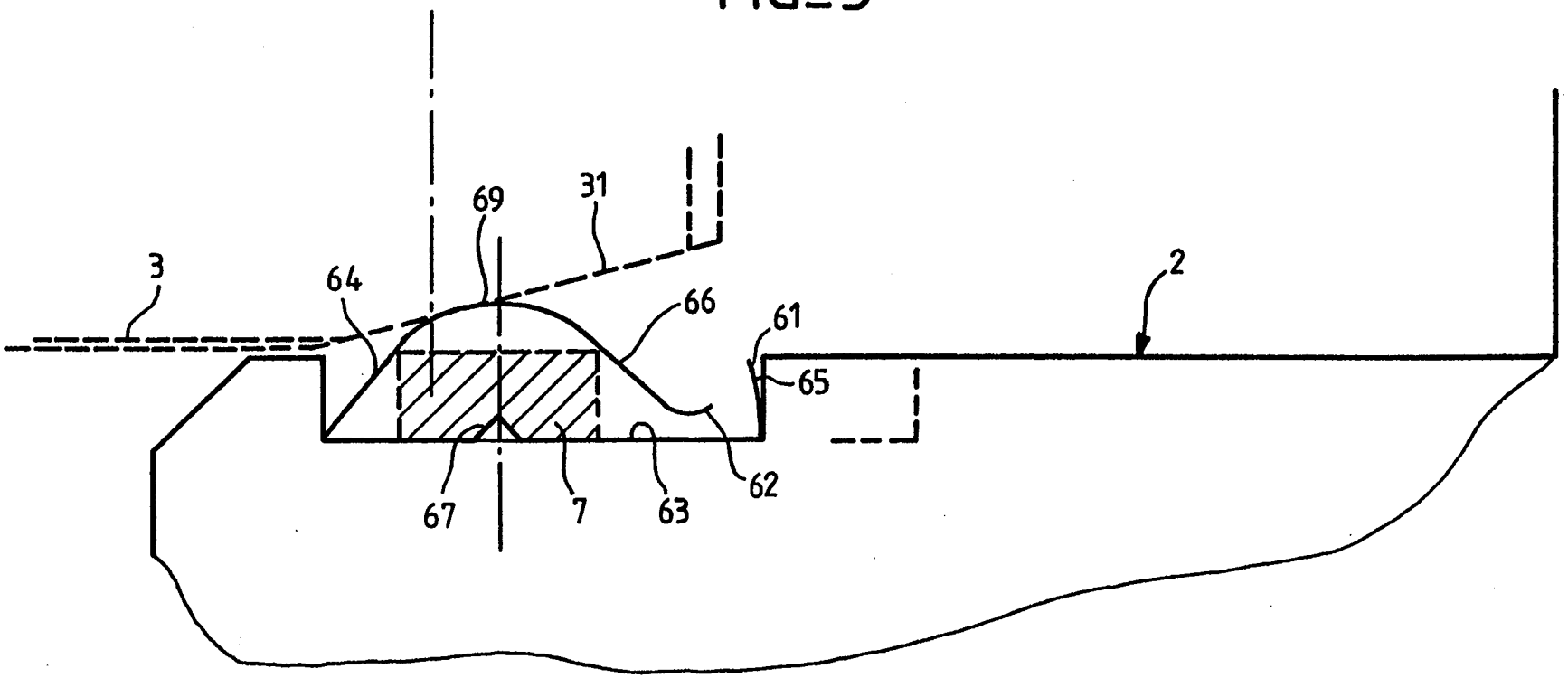
FIG. 5 is a diagram showing the coupling of the male and female members.

In more detail, the shielding band comprises a plurality discrete of contact blades 6 (FIGS. 3 and 4) assembled and held into the groove 4 by an elastic tie 7 (FIGS. 5 and 7). Each contact blade is made from an electrically conductive elastically deformable material, a spring metal, for example, and is shaped as an open loop, the two ends 61 and 62 of this loop being able to move freely relative to each other. To be more specific, as can be seen in FIGS. 3 and 4, the contact blades comprise a main core 63 which is essentially rectilinear (it is designed to mate with the back of the groove 4 on the male member) and each end of which is bent to form two asymmetric branches 64 and 65. The longer branch 64 is curved and the convex side of this branch faces away from the back of the groove 4 in which the individual contact blades are seated. The curved part of this branch 64 is extended by a rectilinear portion 66 at an acute angle to the main core 63. The shorter branch 65 is bent at 90° and preferably an angle substantially greater than 90° and is therefore in a plane substantially perpendicular to the main core 63, its end 61 being spaced from the end 62 of the branch 64.

The central core 63 includes a transverse bend 67 which is triangular in shape, for example, with its apex 68 facing upwards, that is to say towards the convex part 69 of the loop. This bend extends across the full width of the contact blade and cooperates with a complementary shape groove 71 formed on the inside surface of the flexible band 7 (FIG. 7) which in this example is of polygonal cross-section.

The individual contact blades 6 are assembled or to be more precise joined together by the elastic band 7 (FIGS. 1 and 5) which is accommodated inside the loop constituting the contact blade so as to form a coupling agent between the various blades. The band 7 is preferably made from an elastically extensible material to confer radial elasticity upon it so that it can be inserted into the annular seat provided by the groove 4 simply by stretching it whereby it enters and is automatically located in the groove 4 by virtue of its elasticity. The band 7 is in the form of a continuous closed ring accommodated inside the contact blades 6 before they are shaped into open loops or inserted subsequently by relying on the inherent elasticity of the metal which allows some deformation without compromising the shape of the loops, which spring back to their initial shape after the elastic band is fitted.

The contact blades 6 are assembled to the band 7 by virtue of the nesting of their locating bend 67 in the corresponding groove 71 in the band and are positioned and locked into the groove 4 by the band, the width of the contact blades being substantially the same as that of said groove.

Referring to FIG. 8, the band comprises wider parts 71 at the corners of the housing to facilitate location. The wider parts 71, which do not carry any contact blades 6, are substantially more rigid than the remainder of the elastic tie and are positioned at the rounded corners of the respective groove 4. The width of these wider parts 71 is substantially equal to the length of the contact blade 6, for example. When they are fixed into the groove on the male member, as seen in FIG. 1, the contact blades 6 have the convex side of their main branch 64 (constituting the bearing and contact area 69) facing away from the back of the annular groove 4 and these bearing areas 69 project slightly from the periphery 22 of the projecting body of the male member. In this condition the contact blades assume the shape shown in FIG. 3 with the end 62 of the main branch 64 situated at a distance from the main core 63 pressed into the back of the groove 4.

When the male member is introduced into the female member 3 (FIG. 5) the convex parts 69 of the contact blades come into contact with the annular bevel 31 of the female member and the branches 64 retract progressively as the male member is inserted into the female member, the convex parts of the contact blades constituting the bearing area and sliding on the ramp surface provided by the entry bevel 31.

The convex contact surfaces 69 of the elastic blades are thus adapted to be pressed down in the bearing area due to the mechanical coupling pressure and this increases the surface area available for carrying the current.

FIG. 4 shows in full line the position of the branch 64 after deformation, that is to say after insertion of the male member into the female member, and the chain-dotted line shows its initial position before it is deformed, as shown in FIG. 3. Note that the end 62 of the rectilinear portion 66 of the main branch 64 has slid towards the main core 63 relative to the shorter branch 65 which has not been deformed. At the end of insertion the end 62 is in contact with the core 63, which prevents complementary forces increasing the housing insertion force.

Figure 6:
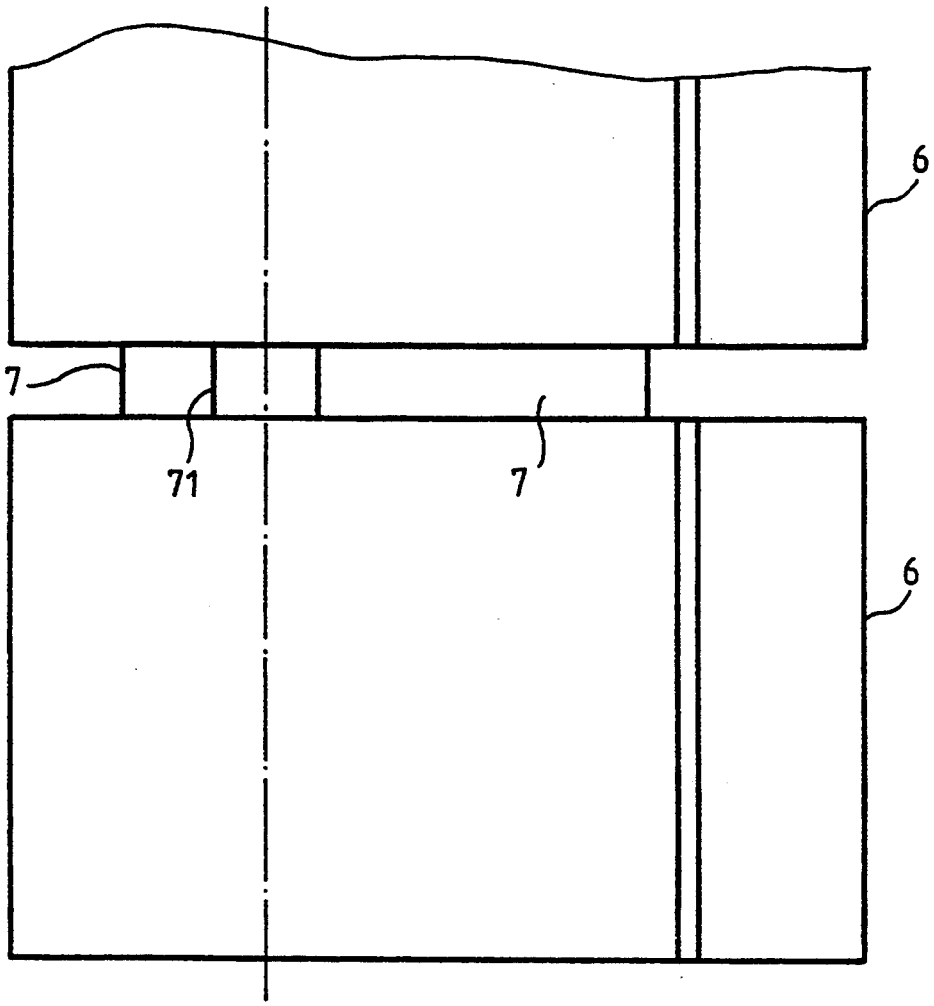
FIG. 6 is a top view of the contact blade.

As can be seen in FIG. 8, the discrete contact blades 6 surrounding the major part of the projecting body of the male member, are spaced from each other and held together by the continuous closed ring elastic tie 7. The rounded corners of this projecting body are free of contact blades but this is not prejudicial to the electrical continuity between the male and female connector bodies given the large number of contact blades on each of the four sides of the body of the male member. FIG. 6 shows two contact blades 6 in the same alignment and automatically located by their bends 67 nested in the groove 71 of the flexible band 7.

Figure 2:
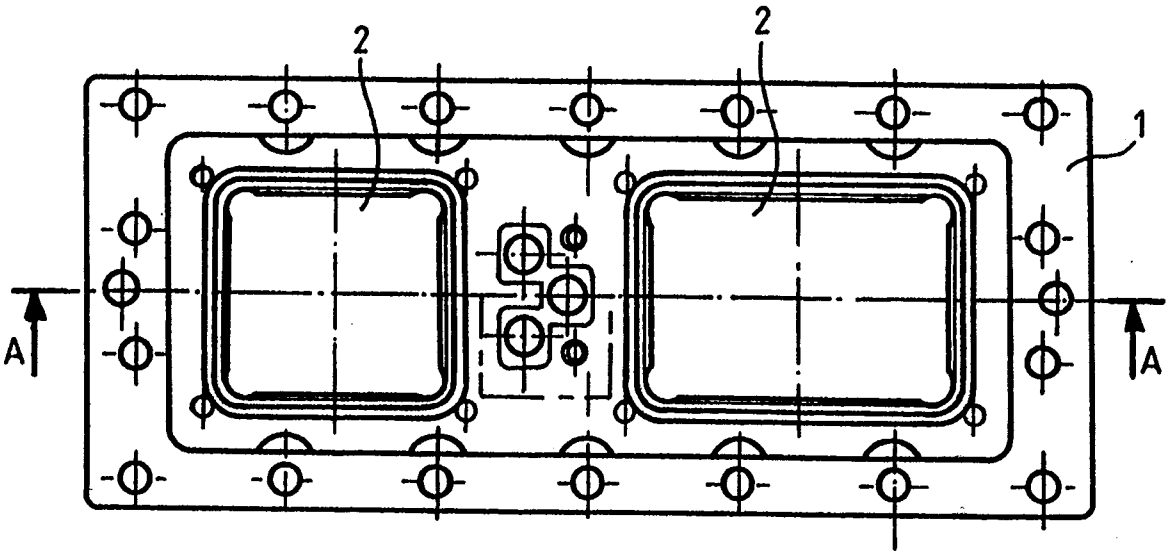
FIG. 2 is top view of the connector housing constituting the male member.

The shape of the projecting body 2 of the male member may naturally be different, for example square or rectangular as shown in FIG. 2. Likewise, it is obvious that this body may be circular without detriment to the concept of the invention in which case an elastic band whose shape and size are appropriate to those of the groove on the male member is used.

Although this is not shown, it would be feasible to use the same concept for shielding bands accommodated in a groove on the inside wall of the female member using a material that can be compressed to insert it into the socket of the female member, after which it expands radially to locate and fix itself into the groove. The shielding band in accordance with the invention thus enables automatic location of discrete contact blades on the flexible tie band in order to form a unitary assembly that is easy to manipulate and which automatically locates in the respective groove of the connector housing without requiring subsequent clipping, glueing, crimping or brazing.

There is claimed:

1. A shielding band for electrical connectors of the type used in housings and comprising:

a plurality of discrete, spring metal, contact blades located in side-by-side relationship in a seat extending along a housing, said discrete contact blades being independent from each other and forming elastically deformable open loops, said loop of each said discrete contact blades comprising a rectilinear main core that mates with said seat completely across said seat in a direction transverse to the direction of extension of said seat, said loop further comprising an elastically deformable, main contact branch overlying said main core, said main core being joined at one end by a first end of said main contact branch, said main contact branch facing said main core and having a second end which is able to move freely relative to said first end of said contact main branch, said shielding band also comprising holding means accommodated inside said loop 5 for holding said discrete contact blades in said seat.

2. The band according to claim 1 wherein said holding means comprises at least one flexible, elastically extensible tie in the form of a continuous, closed ring accommodated inside said loops.

3. The band according to claim 2, wherein said rectilinear main core includes a locating bend for said tie having an apex that faces away from the back of a groove constituting said discrete spring metal contact blade seat.

4. The band according to claim 3, wherein said main contact branch has a convex part which faces the same way as the locating bend and wherein said rectilinear main core is extended at the other end by a branch shorter than said main contact branch and which is bent at substantially 90° with respect to said main core.

5. The band according to claim 3 wherein said elastically extensible tie comprises a loop having a base which is in contact with said rectilinear main core of said contact blades and incorporates a peripheral groove having a shape complementary to that of said contact blade locating bend, said locating bend being engageable in said peripheral groove.

6. The band according to claim 4 wherein said convex part of said main contact branch of said blades constitutes a bearing and contact point of said blades when elastically loaded.

7. The band according to claim 2 wherein said contact blades are spaced all around the periphery of said continuous tie ring which is self-fixing in said seat by virtue of its radial elasticity.

8. The band according to claim 7 wherein said housing, seat, and ring have corresponding corners and wherein said ring has parts wider than the remaining parts of said ring at its corners.

9. The band according to claim 4, wherein the width of said discrete spring metal contact blades is equal to the width of said groove in which each of said discrete spring metal contact blades is seated, the width dimensions being taken transverse to the direction of extension of said seat, the convex part of said main contact branch of said discrete contact blades projecting from the periphery of said housing.

10. The band according to claim 4, wherein said main contact branch and said shorter branch each have terminal ends spaced from each other by a predetermined distance which is less than the height of said elastically extensible tie.

11. An electrical connector comprising:

a pair of connector housings;

a shield band comprising a plurality of discrete, spring metal, contact blades located in side-by-side relationship in an annular seat formed on at least one of said housings, said contact blades being independent from each other and forming elastically deformable open loops, at least one end of each of said loops being able to move freely relative to the other end of said loop; and elastic fixing means for fixing said contact blades to said seat, said fixing means comprising at least one flexible, elastically extensible tie in the form of a continuous, closed ring accommodated inside said loops, said discrete contact blades each comprising a rectilinear main core incorporating a locating bend having an apex that faces away from the back of a groove comprising said contact blade seat, said rectilinear main core being extended at one end by a curved main contact branch having a convex part which faces the same way as the locating bend, said rectilinear main core being extended at the other end by a branch, shorter than said main contact branch and which is bent at substantially 90° with respect to said main core, the ends of the two branches being spaced from one another, said flexible tie incorporating a peripheral groove having a shape complementary to that of said contact blade locating bend.

12. The electrical connector according to claim 11 wherein said contact blades are hairpin-shaped and their ends are freely moveable relative to each other.

13. The electrical connector according to claim 11 wherein said tie is an elastically extensible ring having a base which is in contact with the rectilinear main cores of said contact blades.

14. The electrical connector according to claim 13 wherein said convex part of said main contact branch of said contact blades constitutes a bearing and contact point of said contact blades when elastically loaded.

15. The electrical connector according to claim 13 wherein said contact blades are spaced all around the periphery of said flexible tie ring, said tie ring being self-fixing in said groove by virtue of its radial elasticity.

16. The electrical connector according to claim 13 wherein said housing, groove, and ring have corresponding corners and wherein said ring has parts wider than the remaining parts of said ring at its corners.

17. The electrical connector according to claim 11 wherein the width of said contact blades is equal to the width of said groove in which they are seated, the width dimension being taken transverse to the circumferential direction of said annular seat, the convex part of said main contact branch of said blades projecting from the periphery of said one of said housings.

18. The electrical connector according to claim 11, wherein said main contact branch and said shorter branch each have terminal ends spaced from each other by a predetermined distance which is less than the height of said flexible tie.

* * * * *